United States Patent [19]

Chang

[11] Patent Number: 4,894,033

[45] Date of Patent: Jan. 16, 1990

[54] MULTIPURPOSE AND INFLATABLE RAFT

[76] Inventor: Herry Chang, No. 371-7, Hsin Ming Road, Nei Hu District, Taipei, Taiwan

[21] Appl. No.: 158,327

[22] Filed: Feb. 19, 1988

[51] Int. Cl.[4] ..... B63B 35/72

[52] U.S. Cl. ..... 441/40; 440/21; 440/27; 441/130

[58] Field of Search ..... 114/345; 441/35, 40, 441/65, 66, 129, 130, 131, 332; 440/21, 27, 26

[56] References Cited

U.S. PATENT DOCUMENTS

| | | | |
|---|---|---|---|
| 3,185,125 | 5/1965 | Haman | 440/27 |
| 3,221,696 | 12/1965 | Gardner | 441/35 |
| 3,455,571 | 7/1969 | Dallera et al. | 441/66 |
| 3,518,958 | 7/1970 | McCarthy | 440/104 |
| 4,376,420 | 3/1983 | Fracarossi | 440/27 |
| 4,708,676 | 11/1987 | Lin | 440/27 |

FOREIGN PATENT DOCUMENTS

| | | | |
|---|---|---|---|
| 1432404 | 2/1966 | France | 441/131 |
| 2108435 | 5/1983 | United Kingdom | 441/130 |

*Primary Examiner*—Joseph F. Peters, Jr.
*Assistant Examiner*—Stephen P. Avila
*Attorney, Agent, or Firm*—Lowe, Price, LeBlanc, Becker & Shur

[57] ABSTRACT

A multipurpose and inflatable raft mainly composed of an inflatable circular raft unit, an inflatable shperical raft unit and an inflatable back seat, wherein said circular raft unit comprising several retainer plates for the connection with the retaining rings of the spherical raft unit so as to form a raft of high buoyance, and by means of fixtures attached to the circular raft unit for the fixation of pedalling device to form a pedalling raft, and by means of locating plates arranged bilaterally to the circular raft unit for the fixation of either oar for use in water or braking rod for use in snow-skiing as a braking device.

12 Claims, 12 Drawing Sheets

MULTIPURPOSE AND INFLATABLE RAFT

BACKGROUND OF THE INVENTION

The purpose of the present invention is to provide a multipurpose and inflatable raft and, more particularly, a raft composed of one or more raft units for use in both water activities and activities on snow and ice.

Recreational implements used for water activities during the summer typically may not also be used for snow and ice activities during the winter. In addition, most recreational implements for use in water and ice are so large in size that the manufacturing, storing and transporting of these implements are inconvenient and costly.

In view of these shortcomings, the present multipurpose and inflatable raft has been created to provide the following features:

1. The size of the raft invention of the present invention can be minimized while not in use. When in use it can be assembled into several such units to form configurations desired to meet specific requirements.

2. Two or more raft units according to the present invention can be combined together so as to form a raft or proper size which provides high buoyancy and security to prevent the assembled raft from suffering damage due to tearing of one of the raft units.

3. The raft of the present invention can be used for a variety of purposes, such as playing games while sitting, kneeling, or lying on the back or stomach. It can be used for water skiing, snow skiing, surfing, pedaling individually or with a coordinator or with several people together.

4. The raft of the present invention provides great stability.

SUMMARY OF THE INVENTION

The present invention provides a multipurpose and inflatable raft and more particularly a raft or practical design which is not limited by marketing considerations to summer or wintertime activities. It can be used as an aquaplane, snow ski board, surfboard, main power raft, water boat, or combined raft, and also can be used as a toy or sports implement for one or two or even more people to play in. It employs retaining rings and retainer plates which are attached, respectively, to the outer raft and the inner raft at preferred locations so that both rafts can be combined together as desired. A plate is attached to the rear end of the outer raft for attaching a steering device.

BRIEF DESCRIPTION OF THE DRAWINGS

FIG. 3-1 is a detailed view of the retainer plate and the retaining ring illustrated in FIG. 3.

FIG. 5-1 is a perspective view of the attachment device for the pedaling mechanism.

FIG. 6-1 is a perspective view of the attachment plate for the alternative pedaling mechanism of FIG. 6.

FIG. 7-1 is a magnified view showing attachment of the back seat to the inner raft.

FIG. 7-2 is a cross-sectional view showing attachment of the back seat to the inner raft.

DETAILED DESCRIPTION OF THE PREFERRED EMBODIMENT

Figure 1:
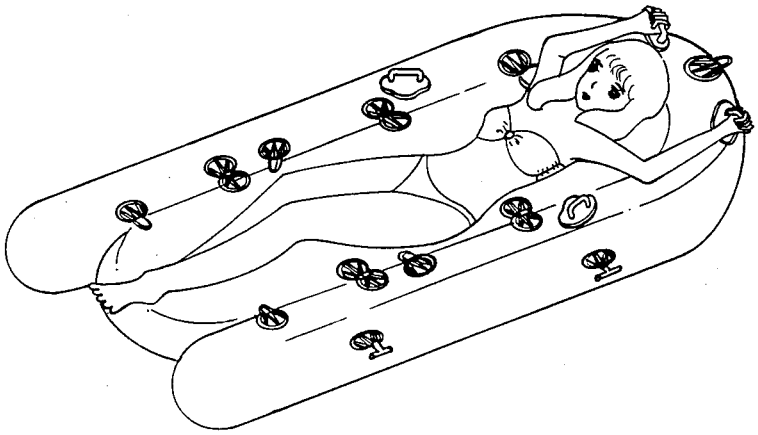
FIG. 1 is a perspective view of a raft embodying the present invention.
Figure 2:
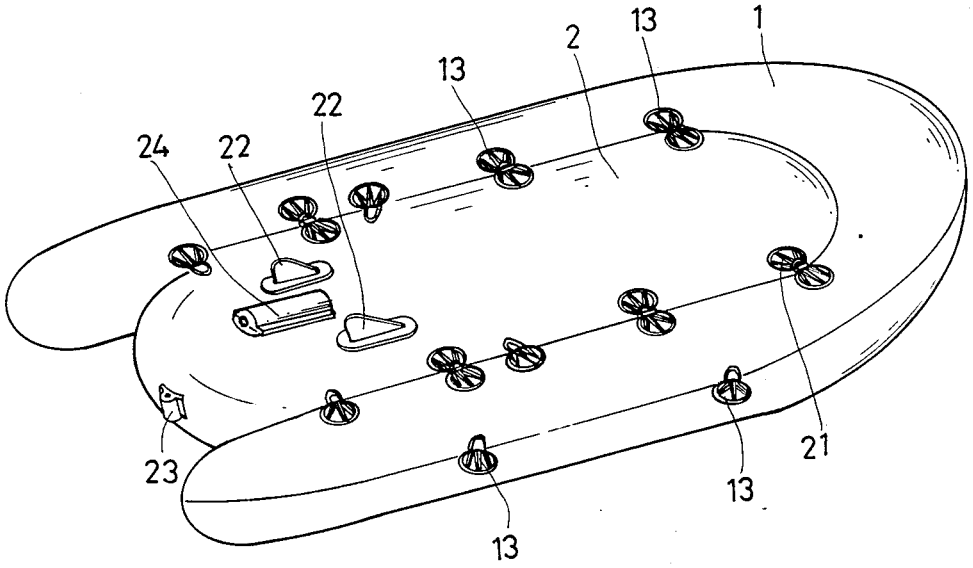
FIG. 2 is an underside view of the preferred embodiment of the present invention.

As shown in FIGS. 1 and 2, the present invention comprises an outer u-shaped raft 1 surrounding an inner oblong-shaped raft 2. Outer raft 1 is inflatable and can be bent to a desired degree to surround inner raft 2. The front edge of outer raft 1 has an air-foil shape to reduce water resistance while running. Outer raft 1 can be inflated to provide high buoyancy. It includes handles 11 and 11' mounted at the front and handles 12 and 12' mounted at the sides. Handles 11 and 11' are used to grasp the raft while lying on the back or on the stomach, while handles 12 and 12' are used to grasp the raft while sitting down or during pedaling. Outer raft 1 also includes several retainer plates 13 arranged around the inner periphery thereof for connection with retaining ring 21 of inner raft 2. It should be understood that retainer plate 13 may be positioned along the periphery of inner raft 2 and retaining rings 21 may be placed along the inner periphery of outer tube 1.

Figure 4:
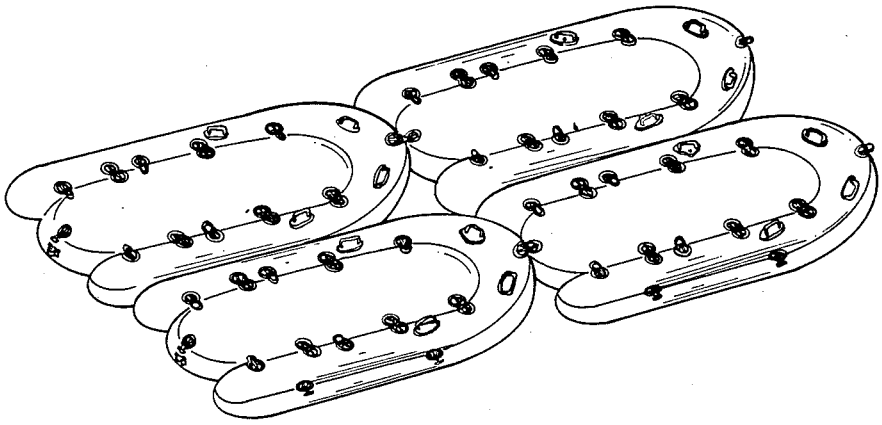
FIG. 4 is a perspective view of several rafts connected together.

Retaining plates 13 are also positioned along the outer periphery of outer raft 1 for connection with adjacent rafts, as shown in FIG. 4. A retainer plate 13 is also positioned at the front of the outer periphery of outer raft 1 so that it can be attached to another raft positioned in front of it, again as shown in FIG. 4.

Inner raft 2 can be conformed to any shape to fit inside outer raft 1, but preferably is either circular or oblong shaped, as shown in FIG. 2. Inner raft 2 acts to support the weight of the user and outer raft 1 provides balance so that the combined unit does not tip over.

Figure 3:
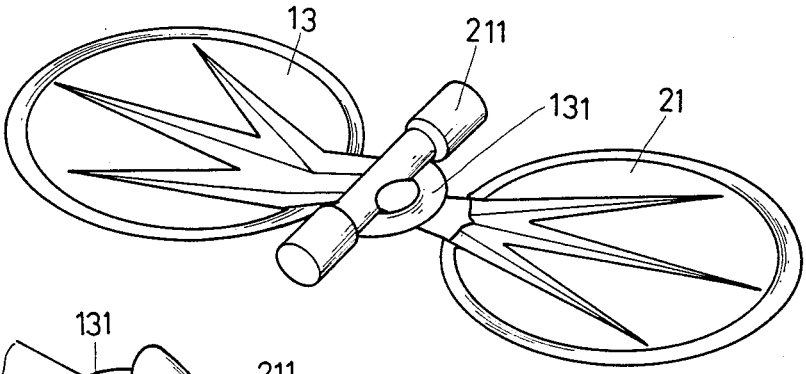
FIG. 3 is a perspective view of a retainer plate and a retaining ring used in the preferred embodiment of the present invention.
Figures 1, 3:
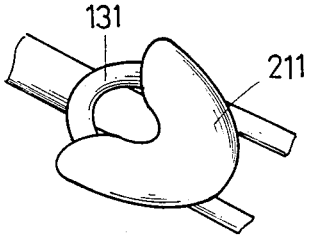

As indicated above, inner raft 2 contains several rings around its periphery on top and on bottom to match with retainer plates 13 of outer raft 1. Referring to FIG. 3, retainer plate 13 and retaining ring 21 are connected by means of retaining hook 211, which may be a latching pin, which is fed through retainer ring 131. Both retainer plate 13 and retaining ring 21 are made of a rugged and flexible material to prevent separation.

Inner raft 2 includes on its bottom side one or more fin stabilizers 22 which allow the overall raft combination to steer in a stable direction. The number of fin stabilizers can be selected according to usage and, if desired, can also be placed on the bottom of outer raft 1.

Figure 5:
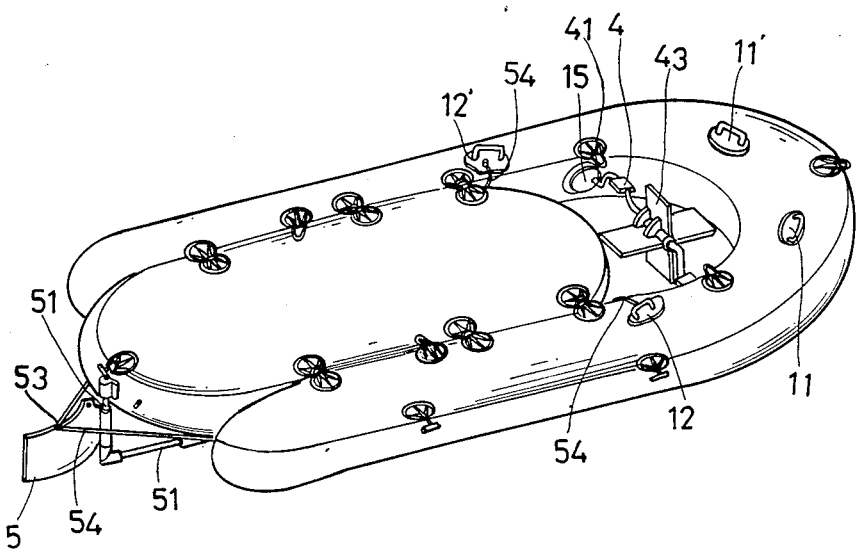
FIG. 5 is a perspective view of the preferred embodiment including a pedaling mechanism.
Figures 1, 5:
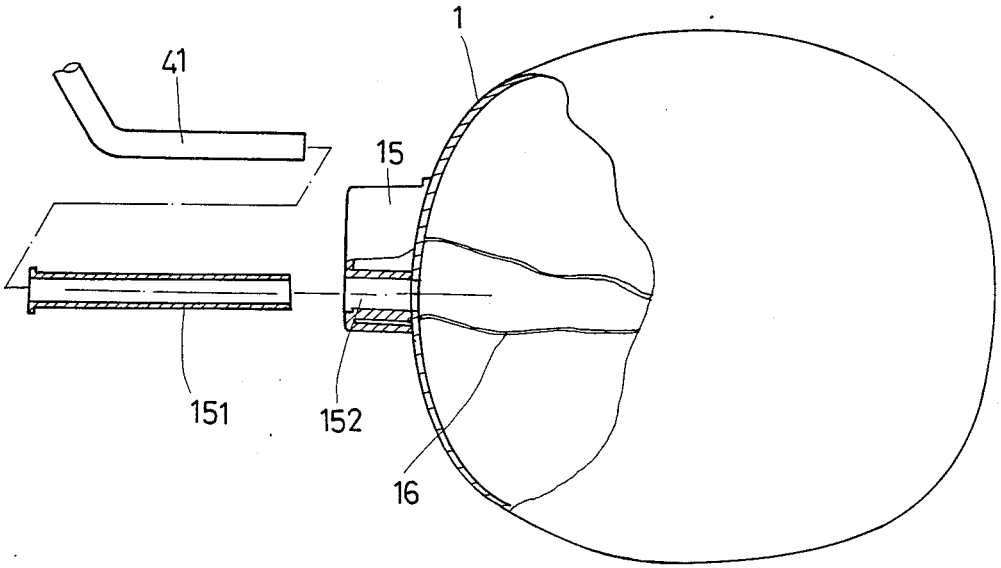

FIG. 5 shows an alternative embodiment of the invention in which inner raft 2 has been shifted toward the rear of outer raft 1 and attached by means of retainer plates 13 and retainer rings 21. In this configuration a space is created between the front of inner raft 2 and outer raft 1 in which a pedaling device 4 is attached by means of fixtures 15 in outer raft 1. A support rod 41 runs between fixtures 15 on either side of the inner surface of outer raft 1. A paddle 43 is attached to support rod 41 and permits propulsion through the water. Pedaling device 4 is detachable for storage and transportation. Support rod 41 must be long enough to prevent it from becoming disengaged from fixture 15. On the other hand, it must not be so long that it will interfere with the connection of outer raft 1 and inner raft 2.

The structure of fixture 15 is shown in greater detail in FIG. 5-1. Outer raft 1 has a pocket 16. Fixture 15 is mounted on the inner surface of outer raft unit 1 so that annular opening 152 is positioned adjacent to pocket 16. A sleeve 151 is fed through opening 152 into pocket 16. Sleeve 151 is made of a rugged and wear resistant material. Support rod 41 is positioned inside sleeve 151. The stress force on support rod 141 is absorbed by sleeve 151 and distributed by it to fixture 15. Fixture 15 is made of a soft material connected with outer raft 1 by surface contact. Accordingly, it is desirable that fixture 15 be as large as possible in order to adequately distribute this stress force.

Referring to FIGS. 2 and 5, inner raft unit 2 contains a retainer device 24 on its bottom surface and a retainer device 23 on its rear surface through which L-shaped support rod 51 of a sterring device is mounted. One end of supporting rod 51 is positioned in retainer 24 and the other end is positioned in retainer 23. The vertically oriented section of supporting rod 51 is fed through a cylindrical tube attached to steering device 5. Rope 54 is passed through hole 53 in the rudder of steering device 5 and fed under either side of the inner raft to handles 12 and 12', respectively. A person sitting on the raft can then move the rudder portion of steering device 5 to the left by pulling on handle 12' and can move the rudder to the right by pulling on handle 12. When inner raft 2 is inflated, L-shaped supporting rod 51 is firmly fixed to the rear end of this raft unit and steering device 5 is firmly positioned there.

Figure 6:
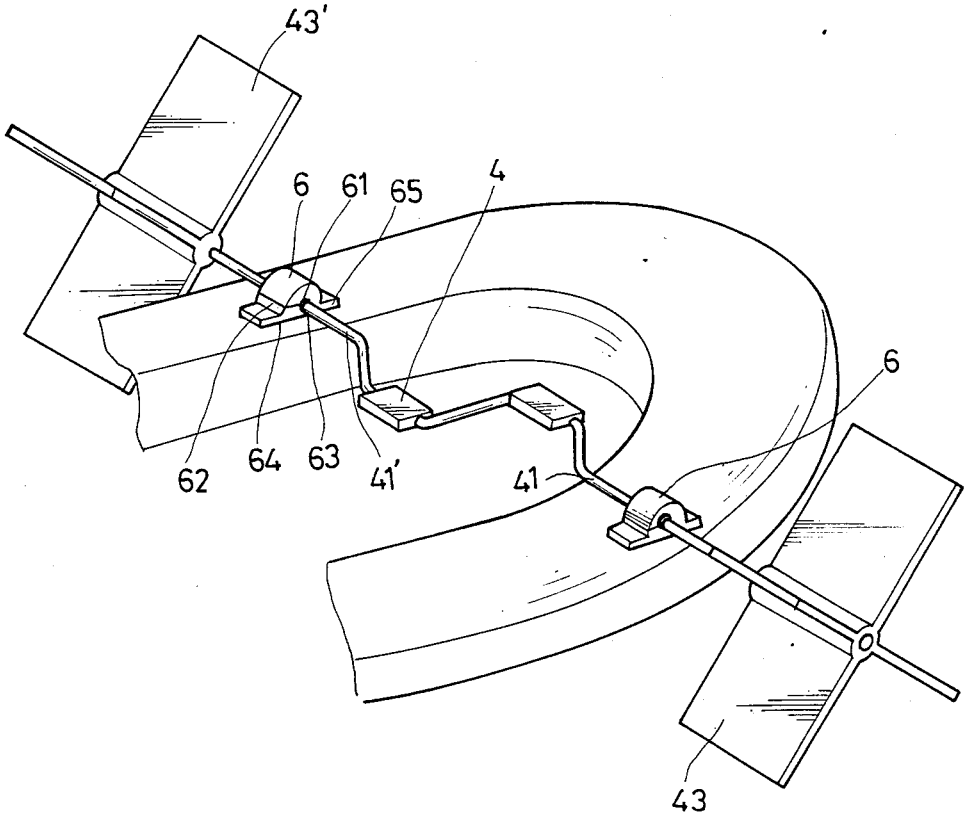
FIG. 6 is a perspective view of an alternative embodiment of the pedaling mechanism of the present invention.
Figures 1, 6:
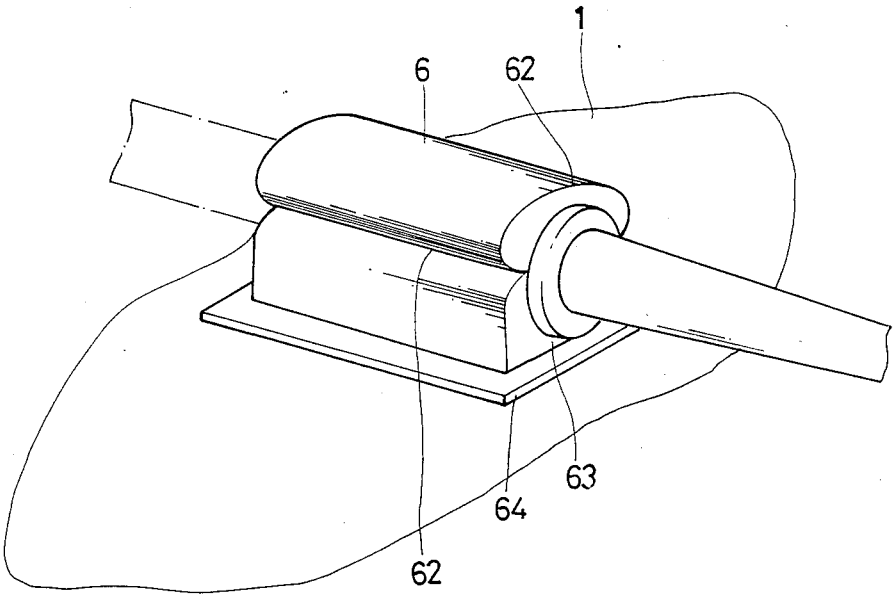

Referring to FIG. 6, an alternative embodiment of pedaling device 4 is shown. Here, the pedals are located in the center of the opening between inner raft 2 and outer raft 1 and paddles 43 and 43' are located opposite one another on the external sides of outer raft 2. Supporting rods 41 and 41' pass over the top surface of outer raft 1 through locating plates 6. Locating plates 6 comprise a flute 62 having a cylindrical hole 61 therein. The interior part of flutes 62 are made of a soft material which can be pried apart for insertion of supporting rod 41 into hole 61 prior to inflation of outer raft 1. When outer raft 1 is inflated, the bottom plates 64 and 65 of flute 62 is forced by the inflation pressure to close flute 62 tightly, thereby keeping supporting rod 41 inside cylindrical opening 61. In this way locating plate 61 acts as a bearing for supporting rod 41 to receive and support the stress forces through supporting rod 41. It should be understood that pedaling device 4 can also be operated by an electric motor to speed up movement of the raft.

Figure 7:
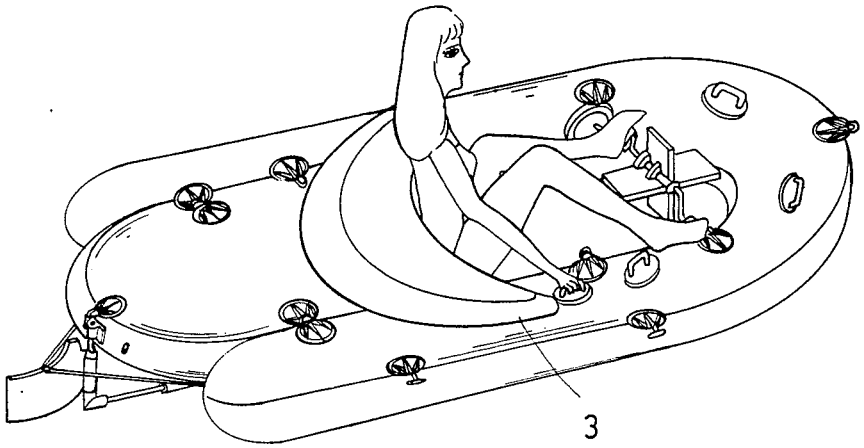
FIG. 7 illustrates the preferred embodiment assembled for pedaling.
Figures 1, 7:
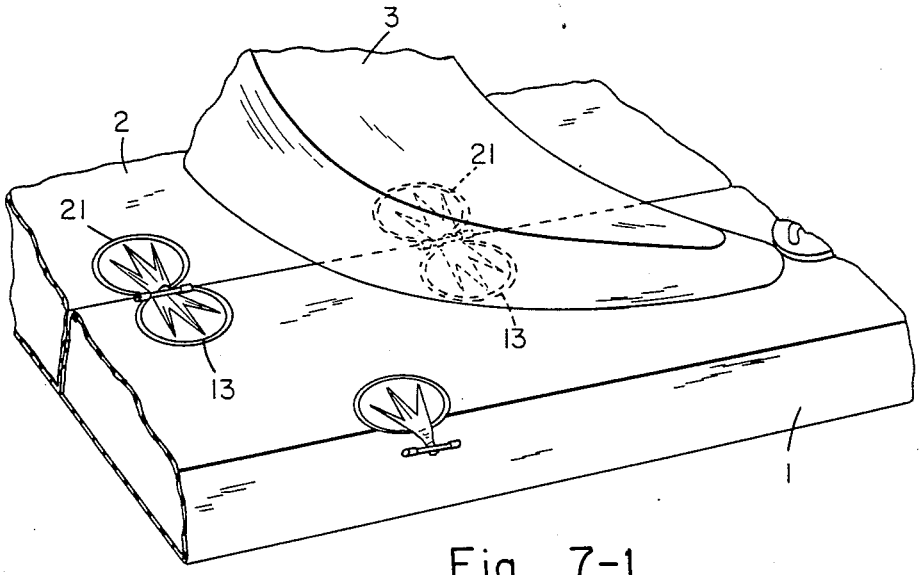
Figures 2, 7:
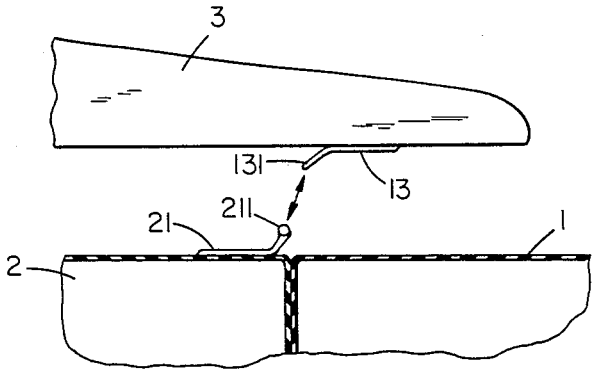

FIG. 7 illustrates the raft with an inflatable backseat 3 which supports the user. Backseat 3 has a retaining ring 131 which is attached to a retainer plate 13 on outer raft unit 1, as shown in FIG. 3. Retaining hook 211 on retaining ring 21 is inserted into retaining ring 131 to fasten back seat 3 to inner raft 2, as shown in FIGS. 7-1 and 7-2.

Figure 8:
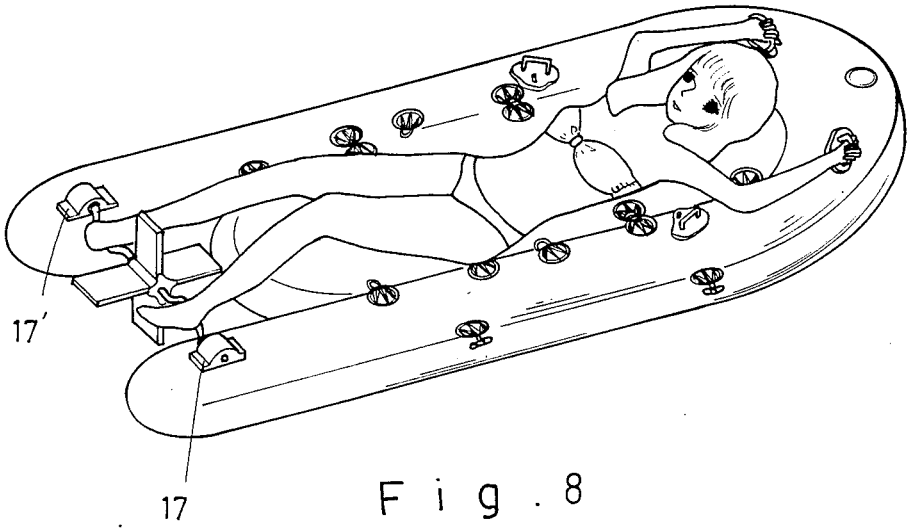
FIG. 8 is a perspective view of the pedaling mechanism attached at the rear of the outer raft.

In FIG. 8 pedaling device 4 is attached to the rear of outer raft unit 1 through locating plates 17 and 17'. In this configuration inner raft unit 2 is positioned forward, so that the user can lie down on either his or her stomach or back with head pointing forward and feet engaging the pedals.

Figure 9:
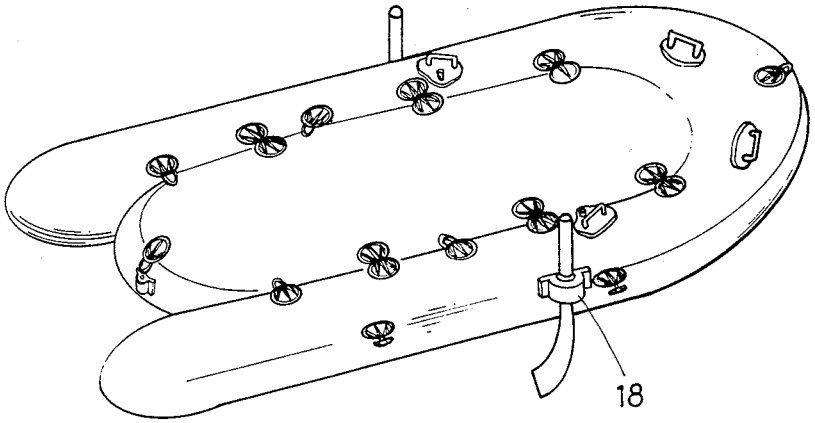
FIG. 9 is a perspective view of the raft of the instant invention assembled for use with rowing oars.

In FIG. 9 two oars are attached at opposite outside portions of outer raft unit 1 by means of oarlocks 18. Alternatively, these oarlocks can be used for a brake rod for use in breaking the raft down when it is used in snow skiing. With such usage the raft can be stopped by means of two brake rods or the skiing direction can be changed by use of only one of the brake rods.

It should be understood that to make the present invention applicable for multipurpose use, both in water as well as on snow or ice, the material of outer raft 1 and inner raft 2 should be weatherproof, wearproof and waterproof. The instant invention may also be used for team play by combining the raft assembly in parallel and/or series. When not in use these rafts can be detached for convenient storage and transportation.

Obviously, numerous additional modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A multipurpose inflatable raft comprising:

an inflatable buoyant outer raft formed in a U-shape and defining a longitudinal axis, with each leg of said U-shaped portion being essentially parallel with said longitudinal axis, wherein said outer raft unit comprises a plurality of retainer plates attached in spaced relationship along the top, bottom and outer surfaces of said outer raft, and a plurality of retaining rings attached in spaced relationship along the outer surface of said outer raft;

an inflatable buoyant inner raft further comprising a plurality of retaining rings attached in a spaced relationship along the top periphery thereof and the bottom periphery thereof, wherein said inner raft may be positioned at spaced locations along said longitudinal axis whereby said retainer plates on said outer raft may be fastened to said retaining rings on said inner raft.

2. The multipurpose inflatable raft of claim 1, further comprising a pair of fixtures attached to opposite inner sides of said outer raft.

3. The multipurpose inflatable raft of claim 1, further comprising a pair of oarlocks attached to opposite outside portions of said outer raft.

4. The multipurpose inflatable raft of claim 1, further comprising an inflatable seat containing a plurality of retainer plates connectable to said retainer rings on said inner raft.

5. The multipurpose and inflatable raft of claim 2, further comprising a pedaling device attached to said fixtures wherein said pedaling device comprises propeller means for propelling said inflatable raft through the water.

6. The multipurpose and inflatable raft of claim 5, wherein each of said fixtures comprises a flute having a cylindrical opening therein, and wherein said pedaling devices further comprises a supporting rod which is inserted into said flute.

7. The multipurpose and inflatable raft of claim 5, wherein said pedaling device further comprises an electric motor coupled to said propelling means.

8. The multipurpose and inflatable raft of claim 1, further comprising a rear retainer attached to the rearward portion of said inner raft, an underside retainer attached at the underside of the rearward portion of said inner raft, and a steering device rotatably connected to said inner raft by said rear retainer and said underside retainer.

9. The multipurpose and inflatable raft of claim 1, wherein said inner raft is elliptical-shaped.

10. The multipurpose and inflatable raft of claim 1, wherein said inner raft is circular-shaped.

11. The multipurpose and inflatable raft of claim 1, wherein a plurality of inner rafts can be mounted between said legs in said outer raft.

12. The multipurpose and inflatable raft of claim 1, wherein said outer raft further comprises a mounting fixture on the rearward portion of each of said legs.

* * * * *